United States Patent [19]

Zweber

[11] Patent Number: 4,546,875

[45] Date of Patent: Oct. 15, 1985

[54] COIN WRAPPER

[75] Inventor: Cyril J. Zweber, White Bear Lake, Minn.

[73] Assignee: Pauline C. Zweber, White Bear Lake, Minn.

[21] Appl. No.: 511,545

[22] Filed: Jul. 6, 1983

[51] Int. Cl.[4] ..... B65D 65/00; B65D 85/62

[52] U.S. Cl. ..... 206/0.82; 53/213; 53/214; 53/447; 53/465; 206/445; 206/446; 206/460; 206/813; 229/87.2

[58] Field of Search ..... 229/87.2; 206/0.8–0.84, 460, 446, 445, 813; 53/213, 214, 447, 465

[56] References Cited

U.S. PATENT DOCUMENTS

| | | | |
|---|---|---|---|
| 1,037,218 | 9/1912 | Dirnberger | 229/87.2 |
| 2,008,168 | 7/1935 | Bergstein | 229/87 R |
| 2,165,539 | 7/1939 | Dahlgren | 206/460 |
| 2,260,150 | 10/1941 | Millard | 229/87.2 |
| 2,371,985 | 3/1945 | Freiberg | 53/465 |
| 2,883,045 | 4/1959 | Abramson | 229/87 R |
| 3,047,144 | 7/1962 | Wissel | 206/0.83 |
| 3,799,428 | 3/1974 | Lamming | 229/87.2 |
| 4,384,644 | 5/1983 | Uchida | 206/0.80 |
| 4,418,120 | 11/1983 | Kealy et al. | 206/813 |

*Primary Examiner*—Stephen P. Garbe

*Attorney, Agent, or Firm*—Merchant, Gould Smith, Edell, Welter & Schmidt

[57] ABSTRACT

A coin wrapper having a paper substrate and a clean releasing pressure-sensitive adhesive is disclosed.

11 Claims, 3 Drawing Figures

COIN WRAPPER

TECHNICAL FIELD

The invention of the present application relates generally to the field of coin wrappers. More particularly, this invention relates to a coin wrapper comprising a flexible paper substrate and a pressure-sensitive adhesive which contacts the coins.

BACKGROUND OF THE INVENTION

Various types of coin wrappers are well known in the art and have been used for many years to facilitate the handling and storage of coins. Typically, such wrappers are made of a flexible substrate which encloses a stacked roll of coins all having the same valuation. The coin wrappers are typically designed to accomodate a convenient unit of value, for example $5 or $25 worth of coins.

A useful coin wrapper must be flexible enough to conform to the diameter of a roll of coins. It must be strong enough to maintain the coins in a stacked roll without splitting, tearing, or otherwise releasing the coins when repeatedly and sometimes roughly handled. However, the useful coin wrapper must also quickly and easily release the coins when needed. It is also desirable that a coin wrapper be adapted for machine rolling of coins, to eliminate the need for tedious hand rolling.

Coin wrappers are used in volume by almost all places of trade handling cash. Financial institutions utilize an enormous quantity of coin wrappers. They are also routinely used by restaurants, service stations, stores, and the like, where it is common to see an employee unwrapping a roll of coins to provide additional change for the cash register.

A variety of coin wrappers have been used in the past or are currenty in use. Paper tubes are very common. Typically, the paper tubes are folded or crimped over the ends of the coin roll to hold the coins in place. Various means are used to remove the coins from such a wrapper. Generally, when the wrapper has folded ends, the ends must be unfolded and the roll manipulated or shaken to dislodge the coins. Removing coins in this way can be time consuming.

Where the ends are crimped, frequently a pull tab is provided somewhere along the length of the wrapper, which when pulled will tear the wrapper away from the coins. However, this has proven unsatisfactory because in many cases the paper does not tear uniformly but instead shreds or breaks off, making the unrolling process more difficult. It also happens that sometimes during handling of the coin rolls, inadvertently the tab is pulled causing the wrapper to tear and coins to spill out. To prevent this, instead of a tab some coin wrappers provide a cut-out or recessed area along a diagonal or lengthwise seam, so that a person can start tearing the wrapper at that point. However, it is generally quite difficult to begin tearing the paper from a cut out area in the absence of long fingernails or other suitable implement. Further, the problems of uneven tearing and shredding still occur.

Another commonly used coin wrapper is a paper wrapper designed to split open when the roll is rapped sharply against a hard surface. Generally the employee or clerk wll strike this wrapper against the cash register to open it. However, the registers in use today are frequently electronic digital instruments having circuitry and a memory system which easily can be damaged by a jolt or strike. Consequently, it is highly undesirable that coin rolls be struck against these registers, and in fact some institutions have posted notices to this effect on their registers.

A more recent development is the clear plastic tube sealed around a roll of coins. This wrapper is known as a "fry tube". It is believed that this wrapper is heat-shrunk around the roll to maintain the coins in the stacked position. It has proven very difficult to remove the coins from the fry tube wrapper. It is not uncommon for the operator of a cash register to have a razor blade on hand to slit open the fry tubes. The presence and use of a razor blade presents obvious dangers and use of the blade can be overly time consuming when customers are waiting.

Thus, substantial need exists for a coin wrapper which will quickly and easily release the coins without cutting, striking, or awkward tearing.

SUMMARY OF THE INVENTION

The present invention is a wrapper for a roll of coins. The wrapper is a flexible substrate having a length and a width. The width of the substrate is greater than the circumference of the coins in the roll, and the length of the substrate is greater than the length of the coin roll. Along its length, which is the direction corresponding to the length of the coin roll, the substrate has as general areas an inside edge and an outside edge. The inside edge is as a general area that length edge closest to the coins when wrapped. At the opposite end of the substrate is the outside edge, which is visible on the outer surface of the wrapper wrapped around a roll of coins.

The substrate also has an inner and an outer surface. The inner surface faces radially toward the coin roll when the roll is wrapped. The outer surface faces radially away from the roll when wrapped.

On the inner surface of the substrate is a coin-supporting amount of an effective clean-releasing pressure-sensitive adhesive in an appropriate configuration.

Specific advantages of the invention will become apparent with reference to the accompanying drawings, detailed description of the invention, and claims.

DETAILED DESCRIPTION OF THE INVENTION

Figure 1:
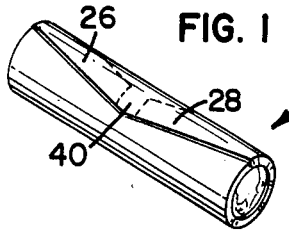
FIG. 1 is a perspective view of a preferred embodiment of the coin wrapper of this invention.

Referring now to the Drawings, wherein like reference numerals denote like elements throughout the several views, FIG. 1 illustrates a coin wrapper 10, rolled about a stack or roll of coins 12. The roll of coins 12 has a length 14, which will depend upon the thickness of each coin in the roll and the total number of coins, and a circumference 16, which is the distance around the coins.

Coin wrapper 10 comprises a flexible substrate or sheet 18. For simple reasons of economy, and for its interaction with the adhesive later described, the substrate is preferably paper.

Substrate 18 includes a length 20 and a width 22. The length 20 of substrate 18 is greater than or equal to length 14 of coin roll 12. Length 20 of the substrate can be significantly greater than the length of coin roll 12, for example, to provide a 1.3 centimeter or more overlap on each side of the coin roll. However, it is preferable that length 20 be no more than approximately 2 millimeters greater than the length of coin roll 12. In the context of this invention, this slight overlap is sufficient to maintain the coins in the roll. Length 20 can also provide substantially no overlap whatsoever, being substantially the same length as the length of the coin roll.

Width 22 of the substrate is at least slightly greater than circumference 16 of the coin roll. Preferably width 22 is approximately twice the circumference, and more preferably, for reasons of a more sturdy wrapped coin roll, approximately at least three times the circumference 16 of the roll.

Side edges 36 and 38 are those substantially parallel edges which are closest the ends of the coin roll when wrapped.

The substrate also includes an inside edge 24 and on outside edge 26, both along its length. Inside edge 24 contacts the length of the coin roll when the roll is wrapped, and is typically covered by an overlapping portion of the substrate and thus is not visible when the roll is wrapped.

Outside edge 26 is located at the opposite end of the substrate from inside edge 24. As seen in FIG. 1, outside edge 26 is visible when the roll is wrapped.

Outside edge 26 can include a tab portion 28. Preferably, tab portion 28 is V-shaped, coming to a point near the center of the roll. Tab portion 28 provides for greater ease in unwinding the coin roll when it is desired to release the coins.

Substrate 18 further includes an inner surface 30 and outer surface 32. Inner surface 30 faces radially toward the roll when wrapped. It is a portion of this surface which is in contact with substantially the entire length and circumference of the coin roll when wrapped. Outer surface 32 generally does not contact the coins, but instead faces radially away from the coins when the roll is wrapped.

Located on inner surface 30 is a coin-supporting amount of an effective pressure-sensitive adhesive 34. Adhesive 34 is located along inside surface 30 in any configuration which will maintain the coins in the desired stack or roll. Effective configurations are illustrated in FIGS. 2 and 3.

Figure 2:
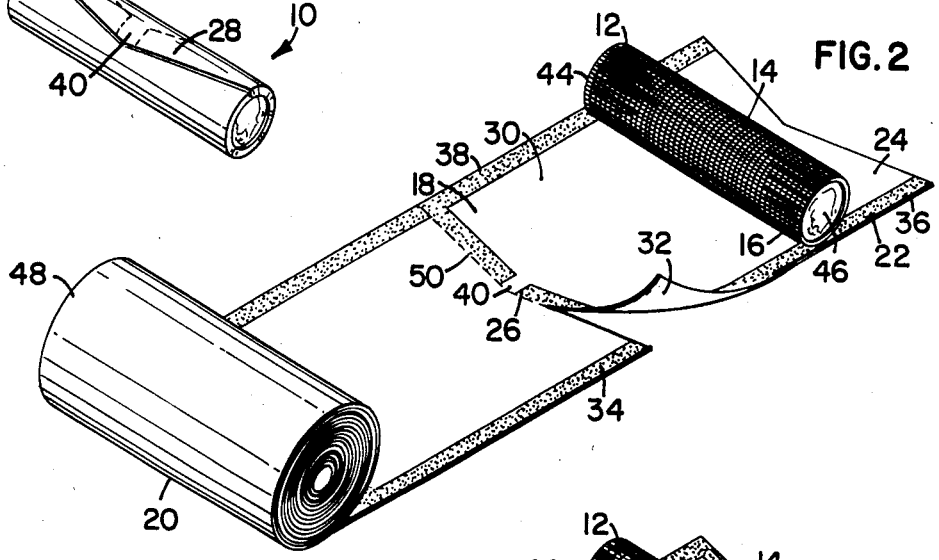
FIG. 2 is a perspective view of a preferred embodiment of a roll of the coin wrappers as shown in FIG. 1.

In FIG. 2, the adhesive is located along edges 36 and 38 and along the inner surface of outside edge 26. There is a break in the adhesive along outside edge 26, at point 40 of tab portion 28. The adhesive along outside edge 26 generally contacts the coin wrapper itself rather than contacting the coins. It serves to maintain the wrapper in the rolled position.

Figure 3:
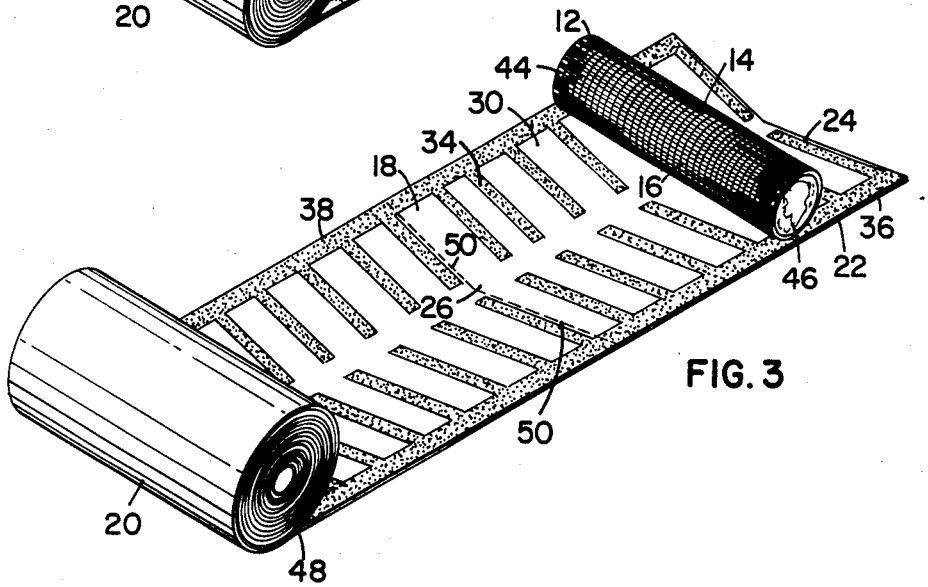
FIG. 3 is a perspective view of a second preferred embodiment of a roll of the coin wrappers as shown in FIG. 1.

FIG. 3 illustrates a preferred adhesive configuration. The adhesive is applied in a series of broken strips. This configuration generally provides sufficient adhesion such that the coin wrapper will remain wrapped but easily can be unwrapped when desired.

The suitable pressure-sensitive adhesives useful in this invention are those which have sufficient adhesion to maintain the coin wrapper in the roller position, but which readily and cleanly release from the coins as the wrapper is removed. The adhesives useful in the context of this invention will leave no discernable trace on the coins, so that the coins will have no sticky or tacky feel. The preferred pressure-sensitive adhesive for use in this invention is an isooctylacrylate homopolymer adhesive cast on a paper substrate at a low coating weight.

One combination of adhesive paper substrate useful in this invention is that combination found in the 3M brand "POST-IT"$^R$ notes.

It is envisioned that a release paper backing could be used over the adhesive if necessary, to be removed prior to use of the wrapper. However, for reasons of economy and simplicity, it is preferred that the adhesive be one which does not require use of a release paper backing.

A wrapped roll of coins can be formed according to this invention by arranging coins in a roll formation having a length 14 and two opposite circular sides 44 and 46 having circumference 16. This coin roll is contacted along its length with the inside edge 24 of the substrate 18. Preferably this is accomplished by simply placing the coin roll along or near edge 24 in a position substantially parallel to length 20 of the substrate and substantially perpendicular to edges 36 and 38. It is preferable that at least a portion of length 14 contact at least a portion of the pressure-sensitive adhesive 34. Preferably, as seen in FIG. 3, the roll will be placed along a strip of adhesive. By placing the roll on a strip of adhesive, the coins are held in place to facilitate wrapping the coin roll. Once the coin roll has been placed on the wrapper, the roll is then rolled or wrapped to form a cylindrical wrapped coin roll as shown in FIG. 1. If desired, and if there is sufficient overlap, edges 36 and 38 can be folded over circular sides 44 and 46.

To release the coins from the roll, one merely lifts tab portion 28 at point 40 and pulls to unwrap the coins. If desired, and if the adhesive allows, the same coin wrapper can be used again one or more times.

It is envisioned that the coin wrappers of this invention can be made available in the form of a large roll 48. Roll 48 comprises at least two or a series of coin wrappers 10 divided or separated by perforations 50. The perforations can delineate a tab portion 28. Such a roll of coin wrappers would be highly useful in financial institutions and other businesses utilizing large numbers of coin wrappers. It would be highly convenient for personnel to merely tear off a wrapper when needed.

Roll 48 could be manufactured by methods known in the art such as where a sheet of paper would be printed with the adhesive pattern and any perforations would be added. It is also envisioned that roll 48 comprising the wrapper of this invention would facilitate machine wrapping of coin rolls.

Further, it is envisioned that the coin wrappers of this invention could be available in tablet or pad form.

Obviously many modifications and variations of the present invention are possible in light of the above teachings. It is therefore to be understood that, within the scope of the appended claims, the invention may be practiced otherwise than as specifically described.

I claim:

1. A wrapped roll of coins, comprising:

(a) a roll of coins having a length and a circumference; and (b) a wrapper comprising:

(i) a flexible substrate having: a substrate length and a substrate width, the substrate width being greater than the circumference of the roll, and the substrate length being at least as great as the length of the roll; along the length of the substrate an inside edge which contacts the length of the roll and, at the opposite end of the substrate, an outside edge; along the width of the substrate a pair of side edges; an inner surface which faces radially toward the roll; and an outer surface which faces radially away from the roll; and (ii) on the inner surface of the flexible substrate proximate the side edges, a coin-supporting amount of an effective clean-releasing pressure-sensitive adhesive, wherein the adhesive securely retains the coins within the wrapper and the coins can be selectively cleanly released from the wrapper without tearing the wrapper, whereby the wrapper can be reused.

2. The wrapper of claim 1 wherein the substrate is paper.

3. The wrapper of claim 2 further comprising a tab portion located at the outside edge.

4. The wrapper of claim 2 wherein the width of the substrate is approximately at least twice the circumference of the roll.

5. The wrapper of claim 2 wherein the width of the substrate is approximately at least three times the circumference of the roll.

6. The wrapper of claim 2 wherein the length of the substrate is no more than approximately 2 millimeters greater than the length of the roll.

7. The wrapper of claim 1, wherein the adhesive comprises an isooctylacrylate homopolymer.

8. A method for selectively holding a roll of coins having a circumference, a length, two ends and two opposite circular sides comprising:

(a) arranging coins to form the roll of coins;

(b) selecting a flexible substrate having: a substrate length and a substrate width, the substrate width being greater than the circumference of the roll, and the substrate length being at least as great as the length of the roll; along the length of the substrate an inside edge which is suitable for contacting the length of the roll and, at the opposite end of the substrate, an outside edge; along the width of the substrate a pair of side edges; an inner surface suitable for contacting the roll of coins; and an outer surface opposite the inner surface, wherein on the inner surface proximate the side edges is a coin-supporting amount of an effective clean-releasing pressure-sensitive adhesive;

(c) contacting the length of the roll with the inside edge of the flexible substrate such that the ends of the coin roll are in contact with the adhesive;

(d) wrapping the roll in the flexible substrate, wherein the inner surface of the flexible substrate is in operable contact with the coins around the circumference of the roll of coins and wherein the ends of coin roll are securely retained by the adhesive; and (e) removing the flexible substrate to unwrap the roll, wherein the roll of coins is cleanly released and wherein the flexible substrate can be reused.

9. The method of claim 8 further including the step of folding any length of the wrapper extending beyond the length of the roll, over the two opposite circular sides of the roll.

10. The method of claim 8 wherein the method is substantially performed by hand.

11. The method of claim 8 wherein the method is substantially performed by machine.

* * * * *

UNITED STATES PATENT AND TRADEMARK OFFICE

CERTIFICATE OF CORRECTION

PATENT NO. : 4,546,875

DATED : October 15, 1985

INVENTOR(S) : Cyril J. Zweber

It is certified that error appears in the above-identified patent and that said Letters Patent is hereby corrected as shown below:

The Assignee portion of the patent should read as follows:

Assignee: Pauline C. Zweber, White Bear Lake, Minn., part interest

Signed and Sealed this

*Eleventh* Day of *February 1986*

[SEAL]

*Attest:*

DONALD J. QUIGG

*Attesting Officer*

*Commissioner of Patents and Trademarks*